US010297221B2

(12) United States Patent
Hwang et al.

(10) Patent No.: US 10,297,221 B2
(45) Date of Patent: May 21, 2019

(54) DATA DRIVER AND DISPLAY DEVICE WITH THE SAME

(71) Applicants: SAMSUNG DISPLAY CO., LTD., Yongin-si, Gyeonggi-do (KR); SOGANG UNIVERSITY RESEARCH FOUNDATION, Seoul (KR)

(72) Inventors: Moon Sang Hwang, Yongin-si (KR); Weon Jun Choe, Yongin-si (KR); Jun Sang Park, Seoul (KR); Tai Ji An, Seoul (KR); Seung Hoon Lee, Seoul (KR)

(73) Assignees: Samsung Display Co., Ltd., Yongin-si (KR); Sogang University Research Foundation, Seoul (KR)

( * ) Notice: Subject to any disclaimer, the term of this patent is extended or adjusted under 35 U.S.C. 154(b) by 0 days.

(21) Appl. No.: 15/174,845

(22) Filed: Jun. 6, 2016

(65) Prior Publication Data

US 2017/0032759 A1 Feb. 2, 2017

(30) Foreign Application Priority Data

Jul. 31, 2015 (KR) ..... 10-2015-0108610

(51) Int. Cl.
*G09G 3/36* (2006.01)

(52) U.S. Cl.
CPC ..... *G09G 3/3688* (2013.01); *G09G 3/3696* (2013.01); *G09G 2310/0291* (2013.01)

(58) Field of Classification Search
CPC ..... G09G 2310/0291
USPC ..... 345/100
See application file for complete search history.

(56) References Cited

U.S. PATENT DOCUMENTS 6,559,836 B1 * 5/2003 Mori ..... G09G 3/3688 345/100
7,184,016 B2 * 2/2007 Bu ..... G09G 3/3688 345/100
7,986,290 B2 * 7/2011 Yang ..... G09G 3/3688 345/100
8,638,164 B2 1/2014 Son et al.
8,988,402 B2 * 3/2015 Tsuchi ..... H03F 1/0261 330/253
2004/0160407 A1 * 8/2004 Koyama ..... H01L 27/12 345/100
2005/0052401 A1 * 3/2005 Lee ..... G09G 3/2011 345/100
2006/0139258 A1 * 6/2006 Choi ..... G09G 3/3208 345/76
2007/0057874 A1 * 3/2007 Le Roy ..... G09G 3/3233 345/76

(Continued)

FOREIGN PATENT DOCUMENTS

KR 10-2010-0028677 A 3/2010

*Primary Examiner* — Roy P Rabindranath
(74) *Attorney, Agent, or Firm* — Lewis Roca Rothgerber Christie LLP

(57) ABSTRACT

A data driver includes a digital to analog converter configured to receive a reference gray voltage and image data, and configured to generate gray voltages corresponding to the image data, and an output buffer including a plurality of buffer circuits connected to an output terminal of the digital to analog converter, and configured to selectively receive one of the gray voltages.

14 Claims, 8 Drawing Sheets

(56) References Cited

U.S. PATENT DOCUMENTS

| | | | | |
|---|---|---|---|---|
| 2008/0180174 | A1* | 7/2008 | Kim | H03F 1/083<br>330/253 |
| 2010/0033464 | A1 | 2/2010 | Shimatani | |
| 2011/0260746 | A1* | 10/2011 | Huang | G09G 3/006<br>324/760.01 |

* cited by examiner

DATA DRIVER AND DISPLAY DEVICE WITH THE SAME

CROSS-REFERENCE TO RELATED APPLICATION

This application claims priority to, and the benefit of, Korean Patent Application No. 10-2015-0108610, filed on Jul. 31, 2015, in the Korean Intellectual Property Office, the entire contents of which are incorporated herein by reference.

BACKGROUND

1. Field

The present disclosure relates to a data driver and a display device with the same.

2. Description of the Related Art

Generally, a display device using an LCD or an OLED is relatively thin and lightweight with low power consumption, thus being frequently used in monitors, laptops, mobile phones, etc. Such a display device includes a display panel that displays an image by using light transmittance of liquid crystal molecules, or by using light emitted from organic light emitting diodes, and by using a driving circuit for driving the display panel.

SUMMARY

The present disclosure is directed to a data driver capable of reducing an output offset by stabilizing an input voltage, and a display device with the same.

A data driver according to an exemplary embodiment of the present disclosure may include a digital to analog converter configured to receive a reference gray voltage and image data, and configured to generate gray voltages corresponding to the image data, and an output buffer including a plurality of buffer circuits connected to an output terminal of the digital to analog converter, and configured to selectively receive one of the gray voltages.

The digital to analog converter may be further configured to sequentially output the gray voltages, and each of the buffer circuits may be configured to selectively receive a corresponding one of the gray voltages.

Each of the buffer circuits may include a switch connected to the output terminal of the digital to analog converter, and configured to selectively transmit the corresponding one of the gray voltages, a unit gain buffer configured to transmit the corresponding one of the gray voltages from the switch to a data line, and a voltage stabilizer connected between the switch and the unit gain buffer, and configured to stabilize an input voltage of the unit gain buffer.

An output terminal of the switch and an input terminal of the unit gain buffer may be electrically connected, and the voltage stabilizer may include a capacitor connected between the output terminal of the switch and ground.

The voltage stabilizer may include a source follower connected between the output terminal of the switch and the input terminal of the unit gain buffer.

The unit gain buffer may include a folded cascode amplifier.

The unit gain buffer may include a class AB amplifier.

The switch may include a CMOS transistor.

The switches of the buffer circuits may be configured to be sequentially turned on over time, and may be configured to sequentially receive the gray voltages from the digital to analog converter one at a time.

A display device according to another exemplary embodiment of the present disclosure may include a display panel including a plurality of pixels at respective crossing regions of a plurality of data lines and a plurality of gate lines, a gate driver connected to the plurality of gate lines, a data driver connected to the plurality of data lines, and a signal controller configured to control operations of the gate driver and the data driver, wherein the data driver includes a digital to analog converter configured to receive a plurality of reference gray voltages and image data, and configured to generate gray voltages corresponding to the image data, and an output buffer including a plurality of buffer circuits connected to an output terminal of the digital to analog converter, configured to selectively receive one of the gray voltages, and each including a voltage stabilizer for stabilizing an input voltage.

Each of the buffer circuits further may include a switch connected to the output terminal of the digital to analog converter, and configured to selectively transmit a corresponding one of the gray voltages, and a unit gain buffer configured to transmit the corresponding one of the gray voltages from the switch to a data line, and the voltage stabilizer may be connected between the switch and the unit gain buffer, and may be configured to stabilize an input voltage of the unit gain buffer.

An output terminal of the switch and an input terminal of the unit gain buffer may be electrically connected, and the voltage stabilizer may be connected between the output terminal of the switch and ground.

The voltage stabilizer may include a source follower connected between the output terminal of the switch and the input terminal of the unit gain buffer.

The display device may further include a gray voltage generator configured to generate the plurality of reference gray voltages, and configured to transmit the plurality of reference gray voltages to the data driver.

According to the exemplary embodiments of the present disclosure, the data driver and the display device with the same can lower the output offset by stabilizing the voltage inputted to the output buffer in the data driver.

BRIEF DESCRIPTION OF THE DRAWINGS

Example embodiments will now be described more fully hereinafter with reference to the accompanying drawings, in which.

DETAILED DESCRIPTION

Figure 1:
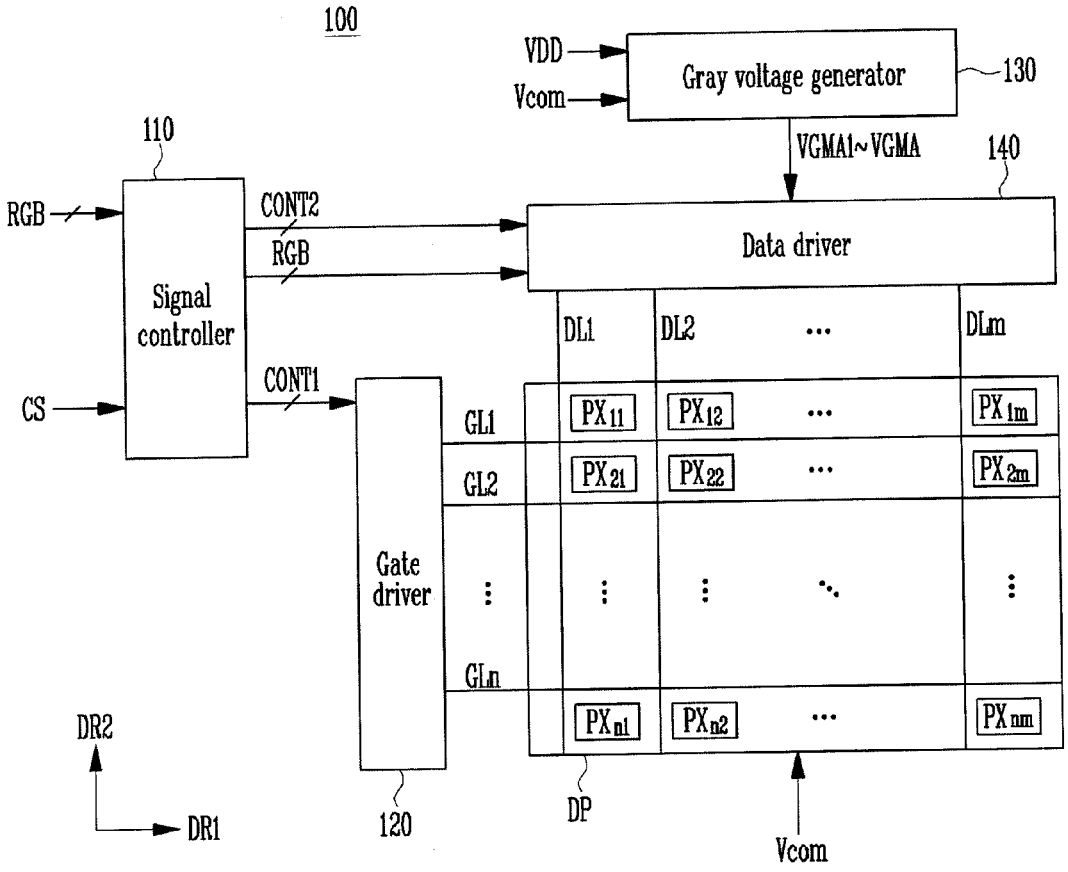
FIG. 1 is a schematic block diagram of a display device according to an exemplary embodiment of the present disclosure.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a schematic block diagram of a display device according to an exemplary embodiment of the present disclosure.

Referring to FIG. 1, the display device 100 includes a display panel DP, a signal controller 110, a gate driver 120, a gray voltage generator 130, and a data driver 140.

The display panel DP may be a transmissive display panel, or a transreflective display panel. For example, a liquid crystal display panel, an electrophoretic display panel, or an electro-wetting display panel may be used as the display panel DP. However, the present disclosure is not limited thereto.

In the case of a liquid crystal display device with the liquid crystal display panel, a backlight unit, which is for supplying light to the liquid crystal display panel, and a pair of polarizers are further included. In addition, the liquid crystal display panel may be any one of a vertical alignment (VA) type, a patterned vertical alignment (PVA) type, an in-plane switching (IPS) type, a fringe switching (FFS) type, and a plane to line switching (PLS) type. However, the present disclosure is not limited to a specific type.

The display panel DP may include a plurality of gate lines GL1 to GLn, a plurality of data lines DL1 to DLm, and a plurality of pixels PX11 to PXnm. The plurality of gate lines GL1 to GLn extend in a first direction DR1, and are arranged in a second direction DR2. The plurality of data lines DL1 to DLm cross the plurality of gate lines GL1 to GLn to be insulated therefrom. The plurality of gate lines GL1 to GLn are connected to the gate driver 120, while the plurality of data lines DL1 to DLm are connected to the data driver 140.

The plurality of pixels PX11 to PXnm may be aligned in a matrix form. Each pixel PX is connected to a corresponding gate line GL of the plurality of gate lines GL1 to GLn, and to a corresponding data line DL of the plurality of data lines DL1 to DLm. The plurality of pixels PX11 to PXnm may also be aligned in a PenTile form.

A pixel PXij may be implemented with a thin film transistor, a liquid crystal capacitor, a storage capacitor, etc. The thin film transistor may be electrically connected to an i-th gate line GLi and to a j-th data line DLj. The thin film transistor may output a pixel voltage corresponding to a data voltage applied from the j-th data line $DL_j$ in response to a gate signal applied from the i-th gate line GLi. The liquid crystal capacitor may store charge corresponding to a difference between the pixel voltage and a common voltage. Alignment of liquid crystal detectors changes according to the amount of charge stored in the liquid crystal, and light incident to a liquid crystal layer may pass therethrough, or may be blocked, depending on the alignment of the liquid crystal detectors. In this manner, the pixel PXij may represent gray corresponding to level of the pixel voltage.

The signal controller 110, the gate driver 120, the gray voltage generator 130, and the data driver 140 control the display panel DP to create an image.

The signal controller 110 receives input image signals RGB, and may transmit them to the data driver 140. Alternatively, the signal controller 140 may convert the received input image signals RGB, and may transmit the converted signals to the data driver 140. In addition, the signal controller 110 receives various control signals CS, such as a vertical synchronization signal, a horizontal synchronization signal, a main clock signal, and a data enable signal, and the signal controller 110 may output a first control signal CONT1 and a second control signal CONT2. The first control signal CONT1 may be applied to the gate driver 120, while the second control signal CONT2 may be applied to the data driver 140. Operations of the gate and data drivers 120 and 140 may be respectively controlled by the first and second control signals CONT1 and CONT2.

The gate driver 120 may output gate signals to the plurality of gate lines GL1 to GLn in response to the first control signal CONT1. The gate signals may be pulse signals of which activating sections are different with each other. Groups of the plurality of pixels PX11 to PXnm may be turned on according to a pixel row in which they are located.

The data driver 140 receives reference gray voltages VGMA1 to VGMAn corresponding to the respective gray-scale levels from the gray voltage generator 130, and may supply data voltages, which corresponds to the data, to the pixels connected to the corresponding gate line in a unit of a pixel row.

The first control signal CONT1 may include a start pulse vertical signal for starting the operation of the gate driver 120, a gate clock signal for determining an output timing of the gate voltage, and an output enable signal for determining a gate-on pulse width of the gate voltage.

The gray voltage generator 300 may generate the reference gray voltages VGMA1 to VGMAn associated with light transmittance of the plurality of pixels PX11 to PXnm using a first driving voltage VDD and a common voltage Vcom. Level of the first driving voltage VDD may be changed depending on the display panel.

The data driver 140 receives the second control signal CONT2 and the image data RGB. The data driver 140 may convert the image data RGB to data voltages based on the gray voltages VGMA1 to VGMAn supplied from the gray voltage generator 130, and may supply them to the plurality of data lines DL1 to DLm.

The second control signal CONT2 may include a start pulse horizontal signal STH (see FIG. 3) for starting the operation of the data driver 140, a polarity control signal for controlling polarities of the data voltages, and a output start signal for determining an output timing of the data voltage.

Figure 2:
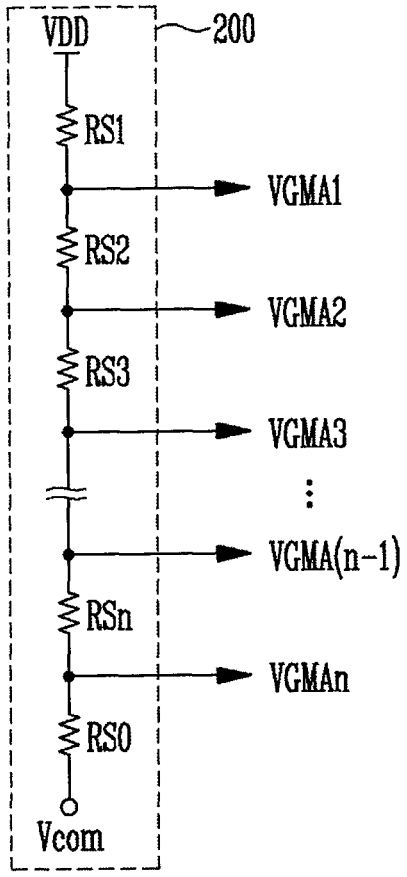
FIG. 2 is a circuit diagram of an embodiment of a gray voltage generator shown in FIG. 1.

FIG. 2 is a circuit diagram of an embodiment of the gray voltage generator shown in FIG. 1. As shown in FIG. 2, the gray voltage generator 200 may include a plurality of resistances RS1 to RSn and RS0 connected in series between the first driving voltage VDD and the common voltage Vcom, and may generate n reference gray voltages VGMA1 to VGMAn. The reference gray voltages VGMA1 to VGMAn may have different levels with each other between the first driving voltage VDD and the common voltage Vcom according to the principle of voltage division.

Figure 3:
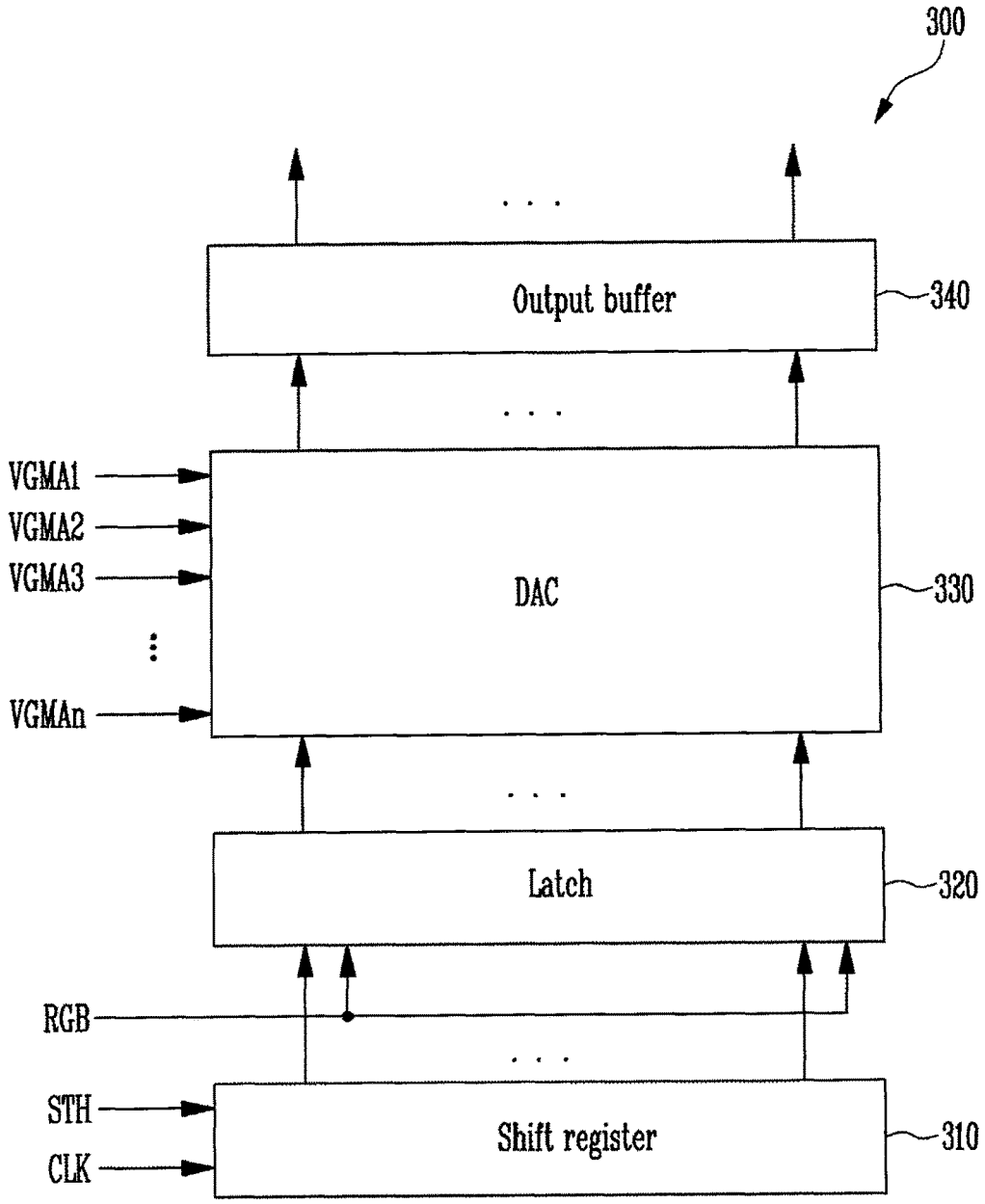
FIG. 3 is a block diagram of an embodiment of a data driver shown in FIG. 1.

FIG. 3 is a block diagram of an embodiment of the data driver shown in FIG. 1. As shown in FIG. 3, the data driver 300 may include a shift register 310, a latch 320, a digital to analog converter (DAC) 330, and an output buffer 340.

The shift register 310 may include a plurality of stages that are subordinately connected to each other. The plurality of stages may receive a data clock signal CLK. A start pulse horizontal signal STH may be applied to the first stage of the plurality of stages. When an operation of the first stage begins with the start pulse horizontal signal STH, the plurality of stages may sequentially output control signals in response to the data clock signal CLK.

The latch 320 may include a plurality of latch circuits. The plurality of latch circuits may sequentially receive the control signals from the plurality of stages. The latch 320 may store image data RGB in a unit of a pixel row. The plurality of latch circuits may respectively store the corresponding image data of the image data RGB in response to the respective control signals. The latch 320 may supply the stored image data RGB corresponding to one pixel row to the DAC 330.

The DAC 330 receives reference gray voltages VGMA1 to VGMAn from the gray voltage generator 130/200. The DAC 330 may include a plurality of digital to analog converting circuits respectively corresponding to the plurality of latch circuits. The DAC 330 may convert the image data RGB supplied from the latch 320 and corresponding to one pixel row to gray voltages.

The output buffer 340 receives the gray voltages from the DAC 330. After buffering the gray voltages, the output buffer 340 may supply them to the data lines DL1 to DLm. The buffered gray voltages may be the reference gray voltages VGMA1 to VGMAn corresponding to the respective gray data supplied from the latch 320. Alternatively, the buffered gray voltages may be voltages that result from amplifying the reference gray voltages VGMA1 to VGMAn corresponding to the respective gray data supplied from the latch 320. The output buffer 340 may output the data voltages corresponding to the respective pixel rows to the plurality of data lines DL1 to DLm in response to the output start signal. The output buffer 340 may include a plurality of buffer circuits, and the number of buffer circuits may be same as that of the data lines DL1 to DLm.

Figure 4:
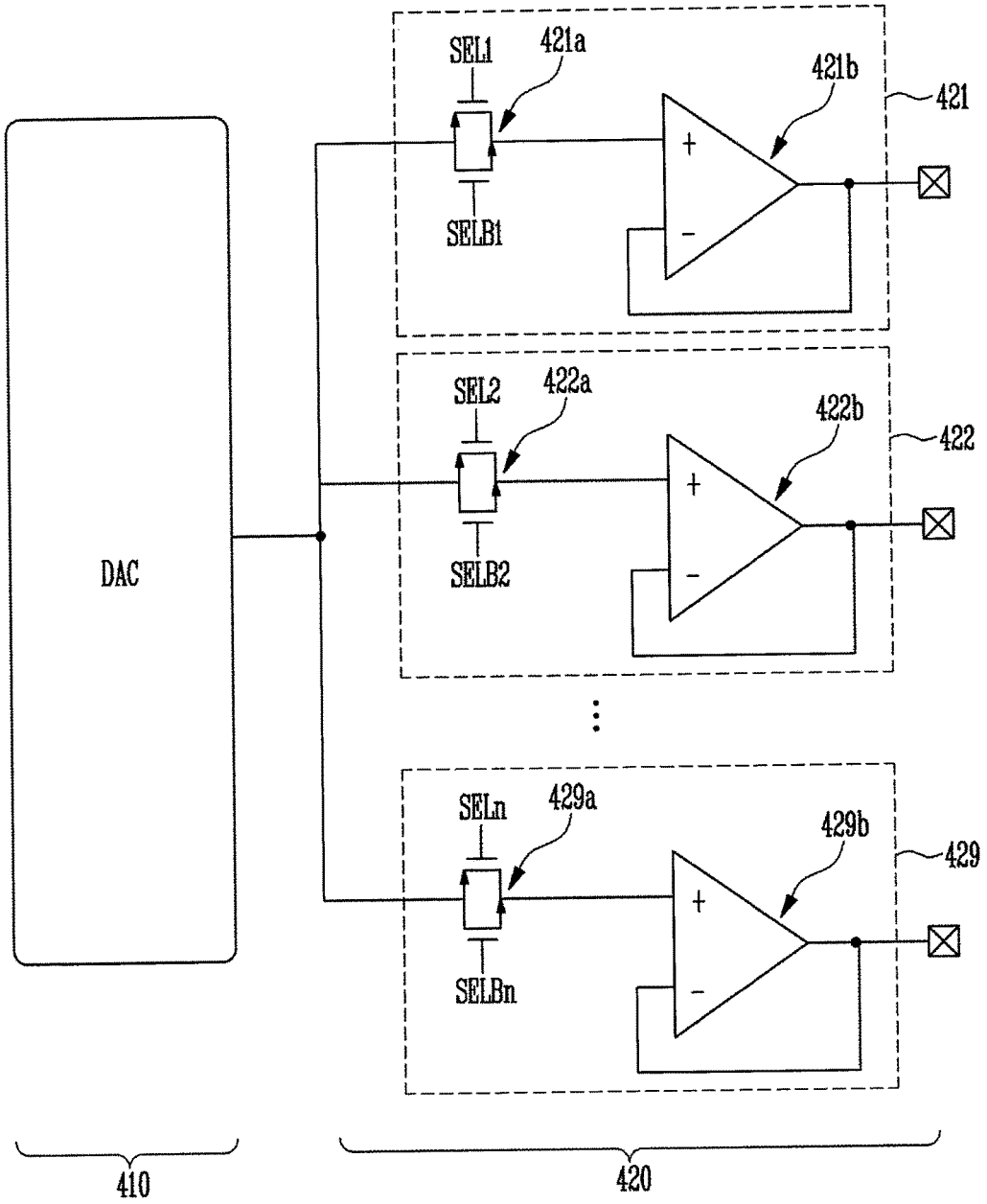
FIG. 4 is a block diagram showing an embodiment of a DAC and an output buffer shown in FIG. 3.

FIG. 4 is a block diagram showing an embodiment of the DAC and the output buffer shown in FIG. 3 in detail. The shift register 310 and the latch 320 of FIG. 3 are omitted in FIG. 4.

According to the exemplary embodiment shown in FIG. 4, the output buffer 420 may include n buffer circuits 421 to 429 ("n" is the natural number). The n buffer circuits 421 to 429 may respectively include switches 421*a* to 429*a* and unit gain buffers 421*b* to 429*b*. The switches 421*a* to 429*a* may be implemented with CMOS transistors. In addition, the n buffer circuits 421 to 429 may include buffers having a predetermined gain value instead of the unit gain buffers 421*b* to 429*b*. The unit gain buffers 421*b* to 429*b* may be implemented with class AB amplifiers.

A conventional data driver is implemented with a structure in which an output of one DAC is shared by the n buffer circuits included in the output buffer. That is, the DAC 410 may sequentially output the gray voltages corresponding to the n buffer circuits 421 to 429 included in the output buffer 420 over time.

In detail, while the DAC 410 outputs a gray voltage corresponding to a first buffer circuit 421, a first switch 421*a* of a first buffer circuit 421 is activated based on a pair of first selection signals SEL1 and SELB1. In this case, because second to ninth switches 422*a* to 429*a* included in second to ninth buffer circuits 422 to 429 are not activated, the gray voltage outputted from the DAC 410 is transmitted to a first unit gain buffer 421*b* of the first buffer circuit 421. Then, while the DAC 410 outputs a gray voltage corresponding to the second buffer circuit 422, the second switch 422*a* of the second buffer circuit 422 is activated based on a pair of second selection signals SEL2 and SELB2. Because the first switch 421*a* of the first buffer circuit 421 and the third to ninth switches 423*a* to 429*a* of the third to ninth buffer circuits 423 to 429 are not activated, the gray voltage outputted from the DAC 410 is transmitted to a second unit gain buffer 422*b* of the second buffer circuit 422. In this manner, the gray voltages corresponding to the buffer circuits 421 to 429 are sequentially supplied to the unit gain buffers 421*b* to 429*b* from the DAC 410.

In the conventional data driver mentioned in the above, when the switches 421*a* to 429*a* of the buffer circuits 421 to 429 in the output buffer 420 are turned on or off, a channel charge flows into input terminals of the unit gain buffers 421*b* to 429*b*, thereby lowering linearity of the unit gain buffers 421*b* to 429*b*.

In addition, because output terminals of the unit gain buffers 421*b* to 429*b* have a large load when compared with the input terminals, inconsistency occurs between the setting time of the input terminal and the setting time of the output terminal. In this case, a change in the output voltage of the unit gain buffers 421*b* to 429*b* brings a change in the input voltage through a parasitic capacitance in the unit gain buffers 421*b* to 429*b*, thereby generating an output offset.

Contrarily, an output buffer according to the exemplary embodiment of the present disclosure may prevent deterioration of the linearity of the unit gain buffers and of the output offset by means of voltage stabilizers, each of which is provided between the switch and the unit gain buffer in the buffer circuit.

Figure 5:
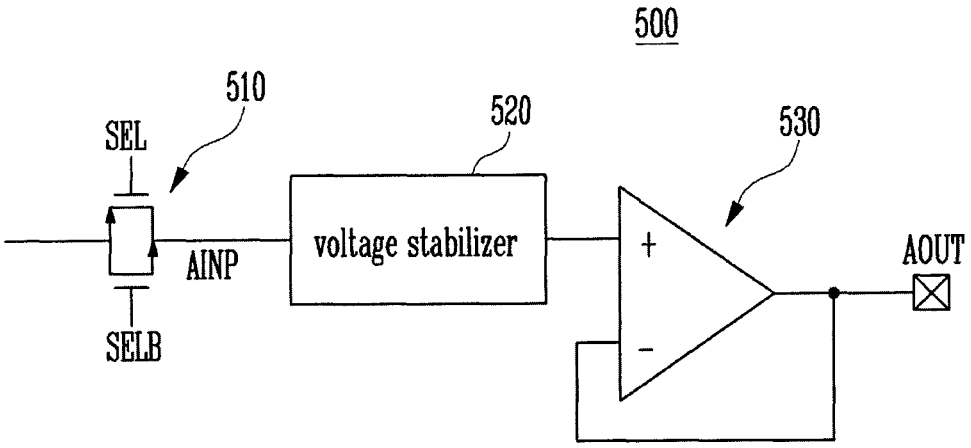
FIG. 5 is a block diagram of any one of a plurality of buffer circuits included in an output buffer according to an exemplary embodiment of the present disclosure.

FIG. 5 is a block diagram of any one of a plurality of buffer circuits included in an output buffer according to an exemplary embodiment of the present disclosure.

Referring to FIG. 5, a buffer circuit 500 of the output buffer according to the exemplary embodiment of the present disclosure includes a switch 510, a voltage stabilizer 520, and a unit gain buffer 530. The switch 510 is connected to an output terminal of a DAC. The switch 510 is turned on when the DAC outputs a gray voltage corresponding to the buffer circuit 500, and transmits the gray voltage to the unit gain buffer 530. For this purpose, while the gray voltage corresponding to the buffer circuit 500 is outputted from the DAC, selection signals SEL and SELB, which are applied to the switch 510, are activated.

The voltage stabilizer 520 is connected to an output terminal AINP of the switch 510. In an exemplary embodiment, the voltage stabilizer 520 reduces the influence of an inflow of the channel charge, which occurs when the switch 510 formed with a transistor is turned on or off, to the input voltage of the unit gain buffer 530. In another exemplary embodiment, the voltage stabilizer 520 minimizes the influence of the parasitic capacitance between the output terminal AINP of the switch 510 and an output terminal AOUT of the unit gain buffer 530. The detailed structure of the voltage stabilizer 520 will be described later with reference to FIG. 6 to FIG. 8.

Figure 6:
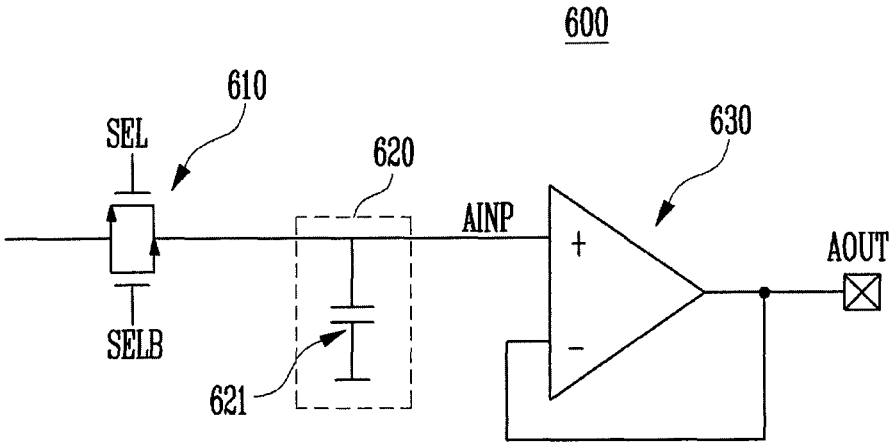
FIG. 6 is a circuit diagram for illustrating a voltage stabilizer according to an exemplary embodiment of the present disclosure.

FIG. 6 is a circuit diagram for illustrating a voltage stabilizer according to an exemplary embodiment of the present disclosure.

Referring to FIG. 6, a voltage stabilizer 620 of a buffer circuit 600 according to an exemplary embodiment of the present disclosure includes a capacitor 621 connected between a switch 610 and a unit gain buffer 630. In more detail, an end of the capacitor 621 included in the voltage stabilizer 620 is connected between an output terminal AINP of the switch 610 and an input terminal of the unit gain buffer 630, while the other thereof may be grounded. As illustrated in the above, in the case in which the voltage stabilizer 620 is implemented with the capacitor 621, a variation in the input voltage of the unit gain buffer 630 can be reduced or minimized, even when the channel charge occurring when the switch 610 is turned on or off flows into the unit gain buffer 630.

Table 1 shows a result of simulation for the error rate resulted from variations in the capacitance value of the capacitor 621 at 25° C. The capacitance value Cs increases from 100 fF (femto-Farad) to 1000 fF in increments of 100 fF. The bit error rate represents an average number of bit errors generated per 10 bits. "$V_L \rightarrow N_H$" represents an error when a low level voltage is shifted to a high level voltage, "$V_H \rightarrow N_L$" represents an error when a high level voltage is shifted to a low level voltage, and $V_{CM}$ represents an error when a common voltage is maintained without a voltage shift.

TABLE 1

| Cs | 100 fF | 200 fF | 300 fF | 400 fF | 500 fF | 600 fF | 700 fF | 800 fF | 900 fF | 1000 fF |
|---|---|---|---|---|---|---|---|---|---|---|
| $V_L \rightarrow V_H$ | 2.518 | 1.509 | 1.081 | 0.842 | 0.690 | 0.580 | 0.504 | 0.448 | 0.398 | 0.353 |
| $V_H \rightarrow V_L$ | 3.133 | 1.756 | 1.217 | 0.929 | 0.751 | 0.630 | 0.542 | 0.478 | 0.425 | 0.383 |
| $V_{CM}$ | 0.360 | 0.197 | 0.137 | 0.099 | 0.080 | 0.068 | 0.057 | 0.049 | 0.046 | 0.042 |

Table 2 shows a result of simulation for the error rate resulted from variations in the capacitance value of the capacitor 621 at 100° C.

TABLE 2

| Cs | 100 fF | 200 fF | 300 fF | 400 fF | 500 fF | 600 fF | 700 fF | 800 fF | 900 fF | 1000 fF |
|---|---|---|---|---|---|---|---|---|---|---|
| $V_L \rightarrow V_H$ | 2.662 | 1.608 | 1.153 | 0.899 | 0.736 | 0.626 | 0.542 | 0.482 | 0.432 | 0.391 |
| $V_H \rightarrow V_L$ | 3.152 | 1.783 | 1.240 | 0.952 | 0.770 | 0.649 | 0.558 | 0.493 | 0.440 | 0.398 |
| $V_{CM}$ | 0.315 | 0.167 | 0.114 | 0.106 | 0.072 | 0.057 | 0.049 | 0.042 | 0.038 | 0.030 |

Table 3 shows a result of simulation for the error rate resulted from variations in the capacitance value of the capacitor 621 at −25° C.

TABLE 3

| Cs | 100 fF | 200 fF | 300 fF | 400 fF | 500 fF | 600 fF | 700 fF | 800 fF | 900 fF | 1000 fF |
|---|---|---|---|---|---|---|---|---|---|---|
| $V_L \rightarrow V_H$ | 2.063 | 1.267 | 0.929 | 0.728 | 0.559 | 0.508 | 0.444 | 0.391 | 0.353 | 0.319 |
| $V_H \rightarrow V_L$ | 2.985 | 1.688 | 1.172 | 0.895 | 0.611 | 0.607 | 0.523 | 0.459 | 0.410 | 0.368 |
| $V_{CM}$ | 0.432 | 0.228 | 0.152 | 0.118 | 0.091 | 0.076 | 0.064 | 0.057 | 0.053 | 0.046 |

When the capacitor 621 is not connected between the output terminal AINP of the switch 610 and the input terminal of the unit gain buffer 630, the bit error rate averages about 2 to about 3 bits. Accordingly, when the capacitor 621 of about 900 fF is connected, the bit error rate is maintained below about 0.5 bits. It can be seen that the influence of the inflow of channel charge on the input voltage of the unit gain buffer 630 is remarkably reduced in comparison to the case in which the capacitor is not provided.

In conclusion, when the capacitor 621 is connected between the switch 610 of the buffer circuit 600 and the unit gain buffer 630, a variation in the input voltage of the unit gain buffer 630 can be reduced or minimized even when the channel charge, which occurs when the switch 610 is turned on or off, flows into the unit gain buffer 630.

Figure 7:
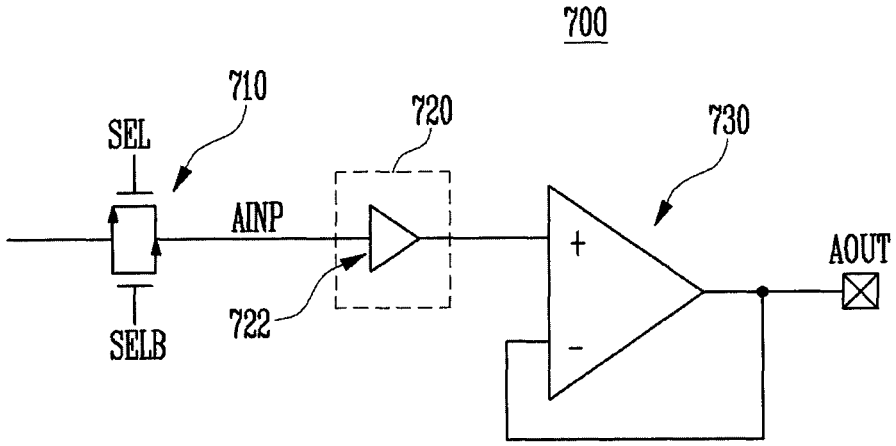
FIG. 7 is a circuit diagram for illustrating a structure of a voltage stabilizer according to another exemplary embodiment of the present disclosure.

FIG. 7 is a circuit diagram for illustrating a structure of a voltage stabilizer according to another exemplary embodiment of the present disclosure.

Referring to FIG. 7, a voltage stabilizer 720 of a buffer circuit 700 according to another exemplary embodiment of the present disclosure includes a source follower 722 connected between a switch 710 and a unit gain buffer 730. In more detail, the source follower 722 is connected between an output terminal AINP of the switch 710 and an input terminal of the unit gain buffer 730. Accordingly, the output terminal AINP of the switch 710 and an output terminal AOUT of the unit gain buffer 730 are not connected with a parasitic capacitance due to the source follower 722. In a conventional buffer circuit, because the output terminal of the switch and a non-inverting input terminal of the unit gain buffer are directly connected, the output terminal of the switch is influenced by the output terminal of the unit gain buffer due to the parasitic capacitance in the unit gain buffer.

However, in the present embodiment, because the source follower 722 is connected between the output terminal AINP of the switch 710 and the input terminal of the unit gain buffer 730 as shown in FIG. 7, the output terminal AINP of the switch 710 is not influenced by the parasitic capacitance in the unit gain buffer 730. Accordingly, the output terminal AINP of the switch 710 is also not influenced by the output terminal AOUT of the unit gain buffer 730.

Like this, because a variation in the voltage of the output terminal AOUT of the unit gain buffer 730 does not affect the output terminal AINP of the switch 710 when the voltage stabilizer 720 is formed with the source follower 722, a variation in the input voltage of the unit gain buffer 730 is reduced, and thus the output offset is also reduced.

Figure 8:
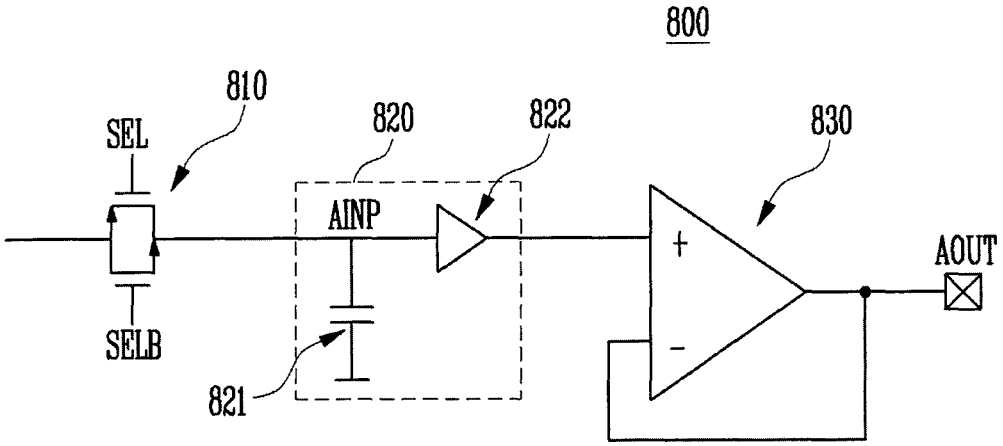
FIG. 8 is a circuit diagram for illustrating a structure of a voltage stabilizer according to still another exemplary embodiment of the present disclosure.

FIG. 8 is a circuit diagram for illustrating a structure of a voltage stabilizer according to still another exemplary embodiment of the present disclosure.

Referring to FIG. 8, a voltage stabilizer 820 of a buffer circuit 800 according to still another exemplary embodiment of the present disclosure includes a capacitor 821 connected between an output terminal AINP of a switch 810 and the ground, and a source follower 822 connected between the output terminal AINP of the switch 810 and an input terminal of a unit gain buffer 830.

In the case in which the voltage stabilizer 820 includes the capacitor 821, similarly to that of FIG. 6, a variation in the input voltage of the unit gain buffer 830 can be reduced or minimized even when the channel charge, which occurs when the switch 810 is turned on or off, flows into the unit gain buffer 830. In addition, the output terminal AINP of the switch 810 and an output terminal AOUT of the unit gain buffer 830 are not connected with a parasitic capacitance due to the source follower 822 included in the voltage stabilizer 820. In a conventional buffer circuit, because the output terminal of the switch and a non-inverting input terminal of the unit gain buffer are directly connected, the output terminal of the switch is influenced by the output terminal of the unit gain buffer due to the parasitic capacitance in the unit gain buffer. However, in this embodiment of the present disclosure, because the source follower 822 is connected between the output terminal AINP of the switch 810 and the input terminal of the unit gain buffer 830 as shown in FIG. 8, the output terminal AINP of the switch 810 is not influenced by the parasitic capacitance in the unit gain buffer 830. Accordingly, it is also not influenced by the output terminal AOUT of the unit gain buffer 830.

Figure 9:
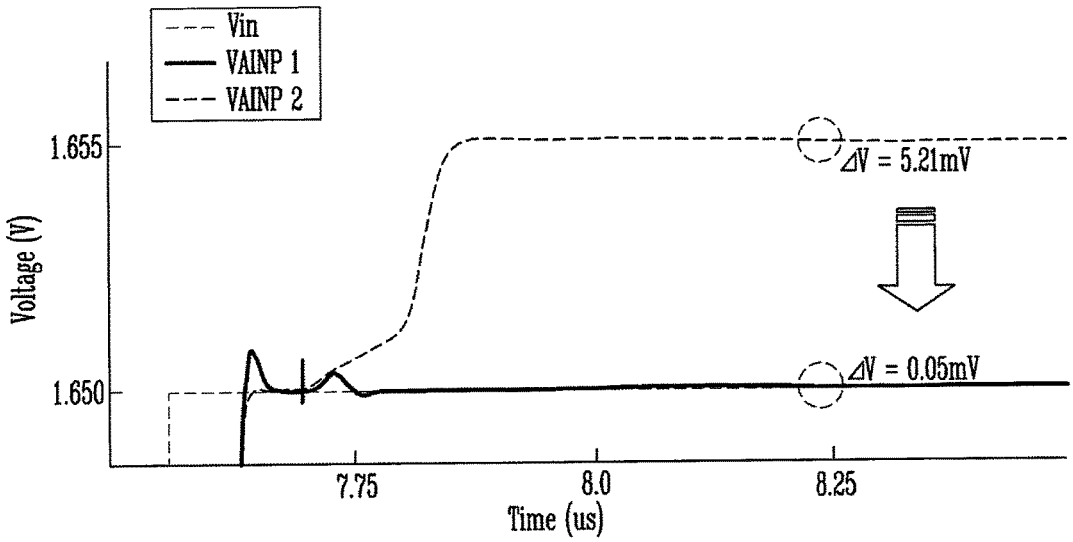
FIG. 9 is a graph illustrating effects of a source follower included in the voltage stabilizer according to the exemplary embodiment of the present disclosure.

FIG. 9 is a graph illustrating effects of the source follower included in the voltage stabilizer according to the exemplary embodiment of the present disclosure. In the case in which the voltage stabilizer includes the source follower, as shown in FIG. 7 and FIG. 8, the output terminal AOUT of the unit gain buffer affects the output terminal AINP of the switch to a lesser degree.

In FIG. 9, Vin is an input voltage applied to the switch, VAINP1 is an offset value of an output voltage when the source follower is connected between the output terminal of the switch and the unit gain buffer, and VAINP2 is an offset value of an output voltage when the source follower is not provided. Referring to FIG. 9, in the case in which the source follower is connected between the output terminal of the switch and the unit gain buffer, according to the exemplary embodiment of the present disclosure, the offset value VAINP1 is about 0.05 mV when the input voltage Vin is about 1.650 mV. However, when the source follower is not provided between the output terminal of the switch and the unit gain buffer, the offset value VAINP2 is 5.21 mV. Accordingly, it can be seen that the source follower provided in the voltage stabilizer according to the exemplary embodiment of the present disclosure can remarkably lower the offset value of the output voltage from about 5.21 mV to about 0.05 mV.

Figure 10:
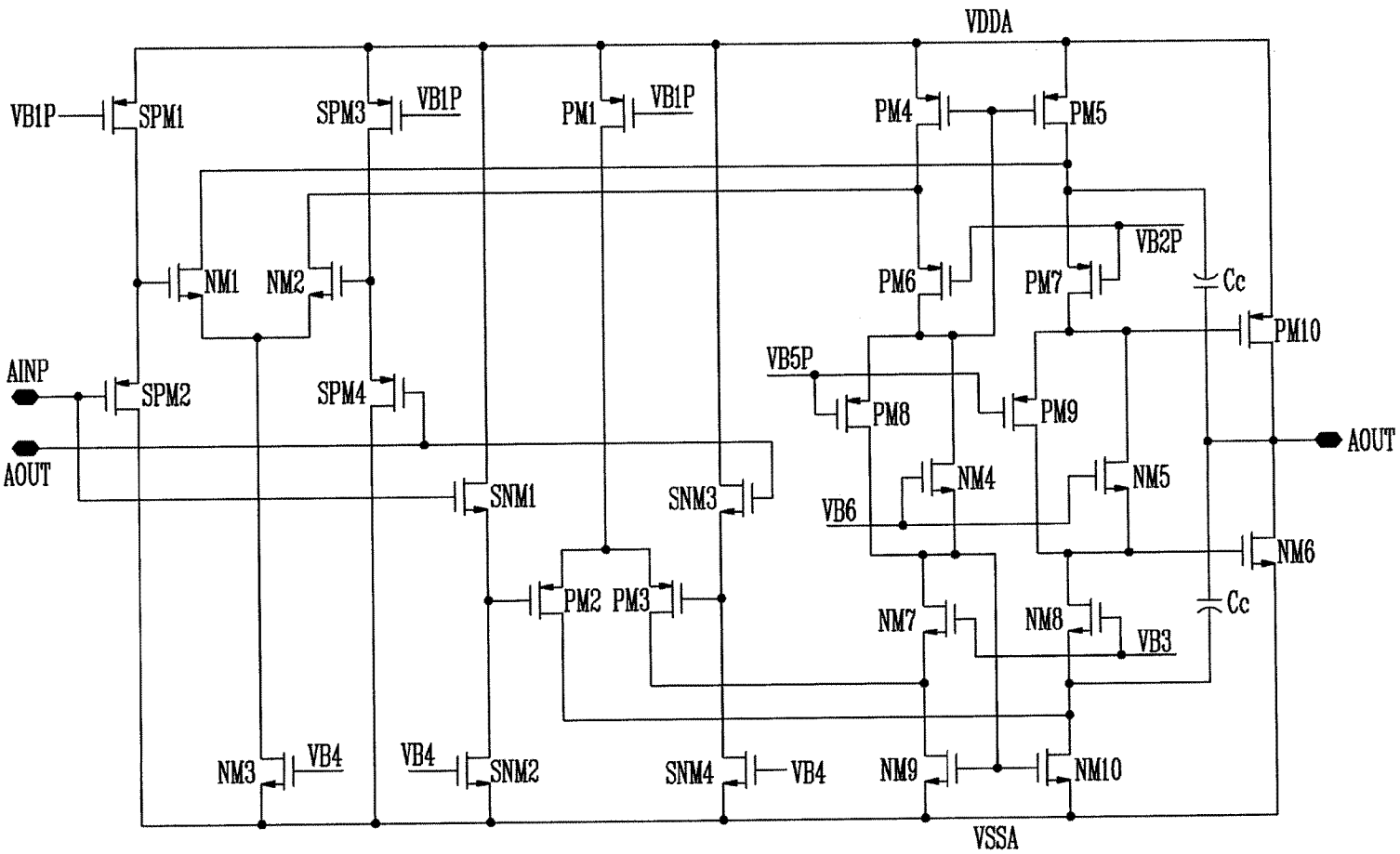
FIG. 10 is a circuit diagram for illustrating a connection structure between the source follower and the input terminal of the unit gain buffer.

FIG. 10 is a circuit diagram for illustrating a connection structure between the source follower and the input terminal of the unit gain buffer. That is, the source follower 722 and the unit gain buffer 730 of FIG. 7 may be structured as the circuit shown in FIG. 10.

Referring to FIG. 10, a circuit 1000 with the unit gain buffer and the source follower consists of a plurality of NMOS transistors, a plurality of PMOS transistors, and a plurality of capacitors. In this structure, the unit gain buffer is implemented by a folded cascode amplifier, and includes ten PMOS transistors PM1 to PM10, ten NMOS transistors NM1 to NM10, and two capacitors Cc. The unit gain buffer is connected to six bias voltages VB1P, VB2P, VB3, VB4, VB5P, and VB6. In addition, the unit gain buffer is connected to a first power voltage VDDA and a second power voltage VSSA.

The source follower includes four PMOS transistors SPM1 to SPM4, and four NMOS transistors SNM1 to SNM4. In addition, the source follower is connected to the bias voltages VB1P and VB4, and the first and second power voltages VDDA and VSSA.

The circuit shown in FIG. 10 is one of possible exemplary embodiments. Accordingly, various circuits in which the source follower is connected to the non-inverting input terminal of the unit gain buffer may be used.

Example embodiments have been disclosed herein and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A data driver comprising:

a digital to analog converter configured to receive a reference gray voltage and image data, and configured to generate gray voltages corresponding to the image data; and an output buffer comprising a plurality of buffer circuits connected to a same output terminal of the digital to analog converter to concurrently receive a same output signal from the digital to analog converter, and configured to selectively receive one of the gray voltages, wherein each of the buffer circuits comprises:

a switch connected to the output terminal of the digital to analog converter, and configured to sequentially transmit a corresponding one of the gray voltages;

a unit gain buffer; and a voltage stabilizer connected between an output terminal of the switch and a non-inverting input terminal of the unit gain buffer, and configured to stabilize an input voltage of the unit gain buffer.

2. The data driver of claim 1, wherein the digital to analog converter is further configured to sequentially output the gray voltages, and wherein each of the buffer circuits is configured to selectively receive the corresponding one of the gray voltages.

3. The data driver of claim 2, wherein the unit gain buffer is configured to transmit the corresponding one of the gray voltages from the switch to a data line.

4. The data driver of claim 1, wherein the output terminal of the switch and the non-inverting input terminal of the unit gain buffer are electrically connected, and wherein the voltage stabilizer comprises a capacitor connected between the output terminal of the switch and ground.

5. The data driver of claim 1, wherein the voltage stabilizer comprises a source follower connected between the output terminal of the switch and the non-inverting input terminal of the unit gain buffer.

6. The data driver of claim 1, wherein the unit gain buffer comprises a folded cascode amplifier.

7. The data driver of claim 1, wherein the unit gain buffer comprises a class AB amplifier.

8. The data driver of claim 1, wherein the switch comprises a CMOS transistor.

9. The data driver of claim 1, wherein the switches of the buffer circuits are configured to be sequentially turned on over time, and are configured to sequentially receive the gray voltages from the digital to analog converter one at a time.

10. A display device comprising:

a display panel comprising a plurality of pixels at respective crossing regions of a plurality of data lines and a plurality of gate lines;

a gate driver connected to the plurality of gate lines;

a data driver connected to the plurality of data lines; and a signal controller configured to control operations of the gate driver and the data driver;

wherein the data driver comprises:

a digital to analog converter configured to receive a plurality of reference gray voltages and image data, and configured to generate gray voltages corresponding to the image data; and an output buffer comprising a plurality of buffer circuits connected to a same output terminal of the digital to analog converter to concurrently receive a same output signal from the digital to analog converter, configured to selectively receive one of the gray voltages, and each comprising a voltage stabilizer for stabilizing an input voltage, wherein each of the buffer circuits comprises:

a switch connected to the output terminal of the digital to analog converter, and configured to sequentially transmit a corresponding one of the gray voltages;

a unit gain buffer; and a voltage stabilizer connected between an output terminal of the switch and a non-inverting input terminal of the unit gain buffer, and configured to stabilize an input voltage of the unit gain buffer.

11. The display device of claim 10, wherein the unit gain buffer is configured to transmit the corresponding one of the gray voltages from the switch to a data line.

12. The display device of claim 11, wherein the output terminal of the switch and the non-inverting input terminal of the unit gain buffer are electrically connected, and wherein the voltage stabilizer is connected between the output terminal of the switch and ground.

13. The display device of claim 10, wherein the voltage stabilizer comprises a source follower connected between the output terminal of the switch and the non-inverting input terminal of the unit gain buffer.

14. The display device of claim 10, further comprising a gray voltage generator configured to generate the plurality of reference gray voltages, and configured to transmit the plurality of reference gray voltages to the data driver.

* * * * *